US006683253B1

(12) United States Patent
Lee

(10) Patent No.: US 6,683,253 B1
(45) Date of Patent: Jan. 27, 2004

(54) COAXIAL CABLE JOINT

(75) Inventor: Chung-Yu Lee, Taipei Hsien (TW)

(73) Assignee: Edali Industrial Corporation, Taipei Hsien (TW)

( * ) Notice: Subject to any disclaimer, the term of this patent is extended or adjusted under 35 U.S.C. 154(b) by 0 days.

(21) Appl. No.: 10/408,117

(22) Filed: Apr. 8, 2003

(30) Foreign Application Priority Data

Oct. 30, 2002 (TW) ..... 91217381

(51) Int. Cl.[7] ..... H01R 9/05
(52) U.S. Cl. ..... 174/75 C; 439/578
(58) Field of Search ..... 174/75 C, 78, 174/84 R, 88 C; 439/578, 583, 584, 585, 610

(56) References Cited

U.S. PATENT DOCUMENTS 3,603,912 A * 9/1971 Kelly ..... 439/273
4,575,274 A * 3/1986 Hayward ..... 403/2
4,583,811 A * 4/1986 McMills ..... 439/584
4,674,818 A * 6/1987 McMills et al. ..... 439/275
5,470,257 A * 11/1995 Szegda ..... 439/578
5,997,350 A * 12/1999 Burris et al. ..... 439/585

* cited by examiner

*Primary Examiner*—Chau N. Nguyen
(74) *Attorney, Agent, or Firm*—Birch, Stewart, Kolasch & Birch, LLP

(57) ABSTRACT

A coaxial cable joint includes a coaxial cable provided with a joint at one end thereof, and the joint further includes an outer tube accommodated around an inner tube having an inner insertion pipe placed therein. The characteristics of the invention are that at a front end of the inner tube is an inner awl bore, and in the outer tube is placed with a leakproof plastic sheath having an outer awl bore at an inner end thereof. The inner tube is pushed into the outer tube in order to slide the outer awl bore of the leakproof plastic sheath into the inner tube and to further compress the leakproof plastic sheath, thereby eliminating a gap between the coaxial cable and the outer tube by inflating the leakproof plastic sheath.

1 Claim, 4 Drawing Sheets

COAXIAL CABLE JOINT

This nonprovisional application claims priority under 35 U.S.C. §119(*a*) on Patent Application No(s). 091217381 filed in TAIWAN, R.O.C. on Oct. 30, 2002, which is(are) herein incorporated by reference.

BACKGROUND OF THE INVENTION a) Field of the Invention

The invention relates to a coaxial cable joint, and more particularly, to a coaxial cable joint disposed at a cable and having a leakproof plastic cover accommodated in the interior thereof, so as to accomplish leakproof purposes while having easy assembly.

(b) Description of the Prior Art

Referring to FIG. 4 showing a conventional joint a disposed at a coaxial cable for video display, the joint a comprises a hollow tube a1 penetrated with a passage a11, such that a core wire b1 of a coaxial cable b is placed within the passage a11; an insulation rubber b2 provided at the outer periphery of the coaxial cable b and enveloped around one end of the tube a1; screw threads a12 and a hex nut a13 provided at the tube a1; a contracted neck portion c1 formed at one end provided with a screw nut c for fastening the screw nut c onto the other end of the tube a1 not enveloped with the insulation rubber b2, and for further fixing the coaxial cable b in the tube a1; a hollow plastic sleeve d located in the screw nut c, so that when the screw nut c is fastened in a direction toward the tube a1, the insulation rubber b1 of the coaxial cable b is entirely enclosed for that the closer the screw nut c approaches the tube a1, the tighter the contracted neck portion c1 becomes around one end of a plastic sleeve d because of the tightening by the contracted neck portion c1 of the screw nut c. Also, plastic material of the plastic sleeve d is deformed due to compressing. As a result, the coaxial cable b is prevented from leaking of water into the interior thereof using the blocking of the plastic sleeve d.

However, in the prior joint a, two hand tools have to be utilized to respectively clamp the joint a and the screw nut c, and forces of opposite directions are imposed in order to fasten the screw nut c toward the direction of the tube a1; hence being complicated regarding to the assembly thereof.

Also, sizes of the joint a and the screw nut c are rather small that it is quite inconvenient during rotation of the hand tools for assembly, and the fastening processes are consequently prolonged. Considering the prevalence of cable TV nowadays, constructions may become relatively slow when cable TV constructors are obligated to set up the aforesaid prior joint a at two ends of each cable one after another, and thus delaying construction speed of putting up cables.

SUMMARY OF THE INVENTION

In the view of the aforesaid shortcomings, the primary object of the invention is to provide a coaxial cable joint having a leakproof plastic sheath accommodated in the interior thereof, so as to accomplish leakproof purposes while having easy assembly.

In accordance with the invention, at one end of a coaxial cable is provided with a joint comprising an inner tube whose one end is accommodated by an outer tube and the other end is disposed with a color ring and a metal ring. In the metal ring and the inner tube is inserted with an inner insertion pipe, and between the inner insertion pipe and the metal ring is disposed with an oval ring in order to place the coaxial cable through one end of the inner tube and to push the inner tube into the outer tube, such that a center cable of the coaxial cable is penetrated through the inner insertion pipe, while leaving the center cable free of contact with the inner insertion pipe and a tubular cable of the coaxial cable in contact and accommodating around the inner insertion pipe. The characteristics of the invention are that, at a front end of the inner tube is an inner awl bore, and in the outer tube is placed with a leakproof plastic sheath provided with an outer awl bore at the interior thereof. Using the aforesaid structure, the inner tube is pushed into the outer tube to have the outer awl bore of the leakproof plastic sheath face the inner awl bore of the inner tube, and to slide the outer awl bore of the leakproof plastic sheath into the inner tube to further compress against the leakproof plastic sheath, thereby eliminating a gap between the coaxial cable and the outer tube by inflating the leakproof plastic sheath while having handy assembly.

DETAILED DESCRIPTION OF THE PREFERRED EMBODIMENTS

To better understand the invention, descriptions shall be given with the accompanying drawings hereunder.

Figure 1:
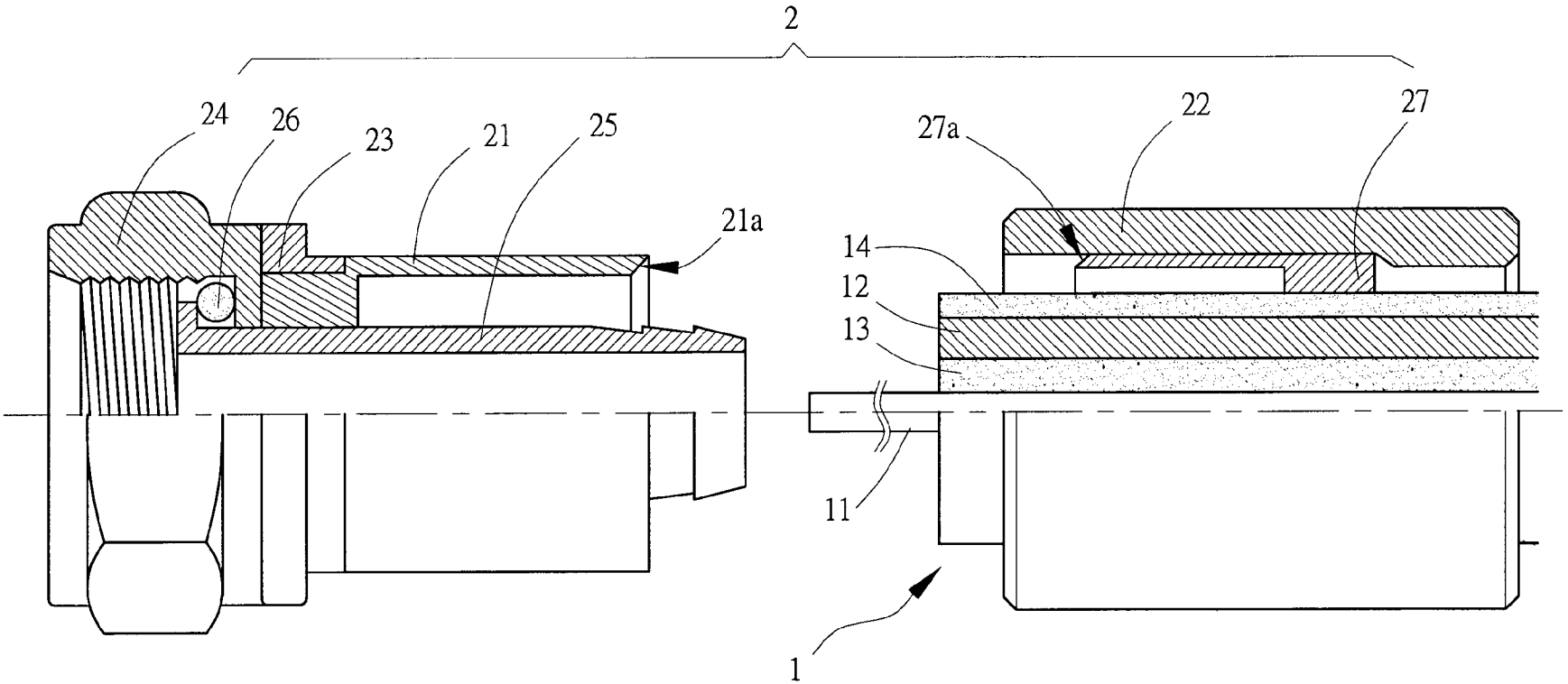
FIG. 1 shows a sectional view of the joint according to the invention before assembly.
Figure 2:
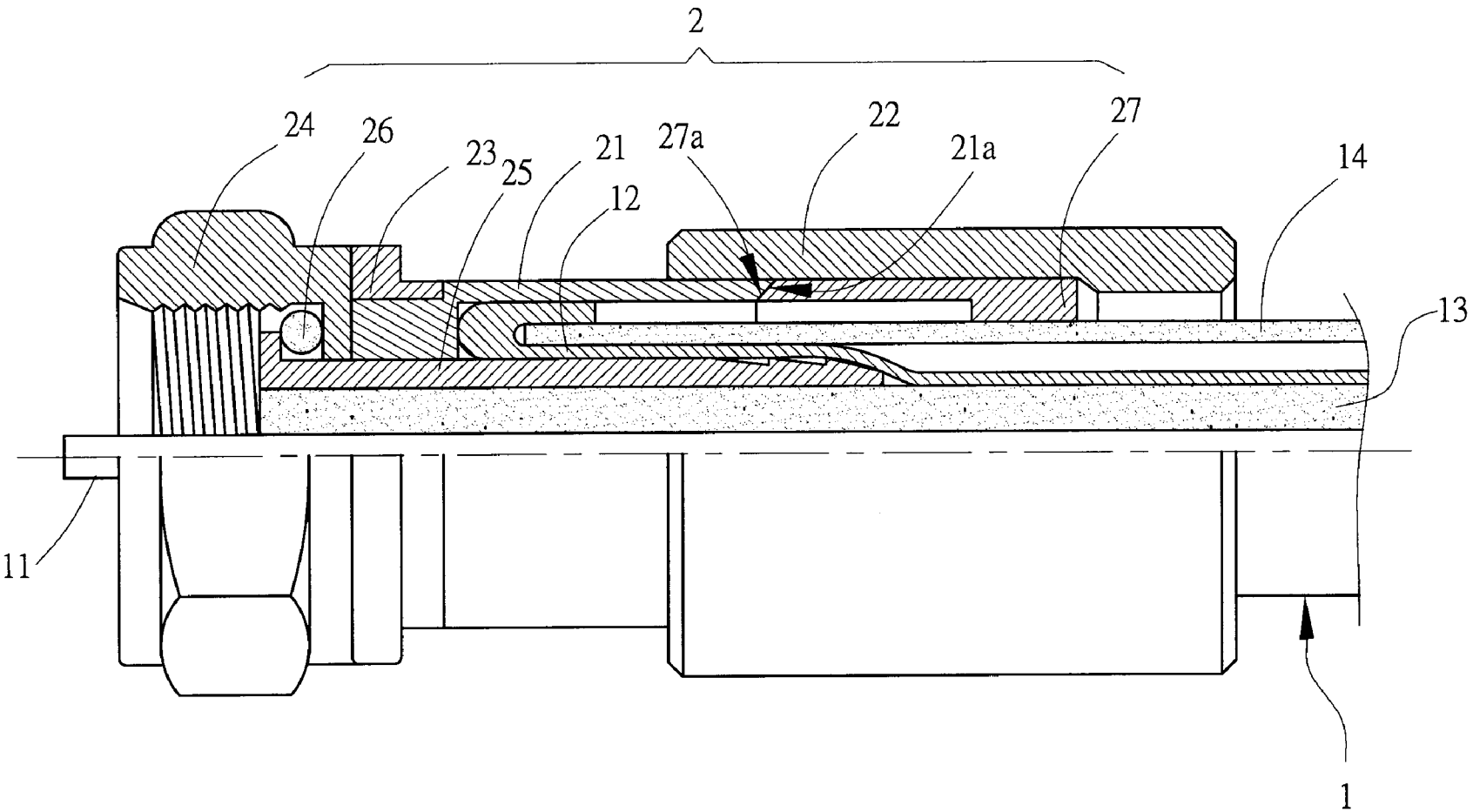
FIG. 2 shows a sectional view of the joint according to the invention during assembly.
Figure 3:
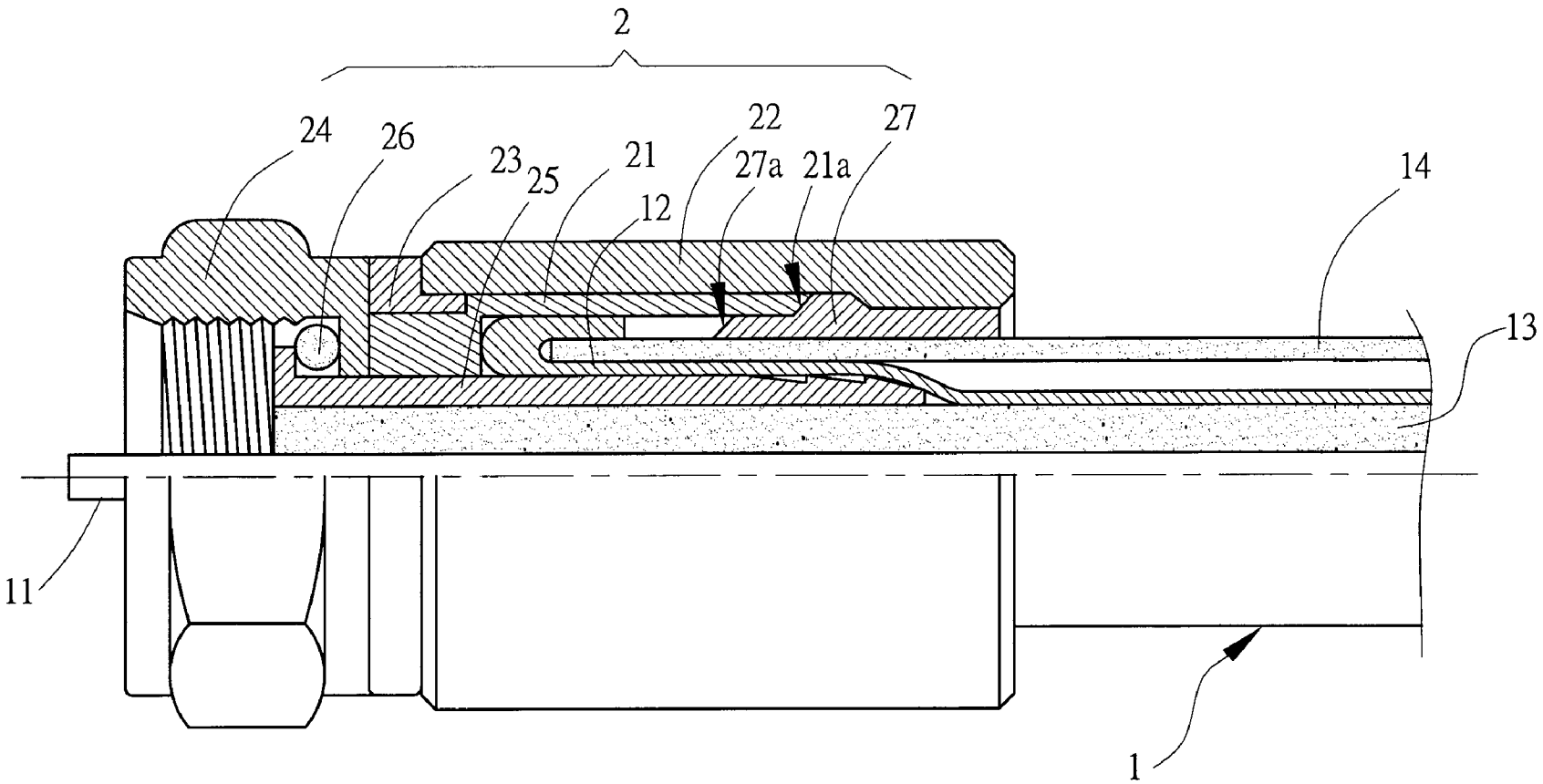
FIG. 3 shows a sectional view of the joint according to the invention after assembly.
Figure 4:
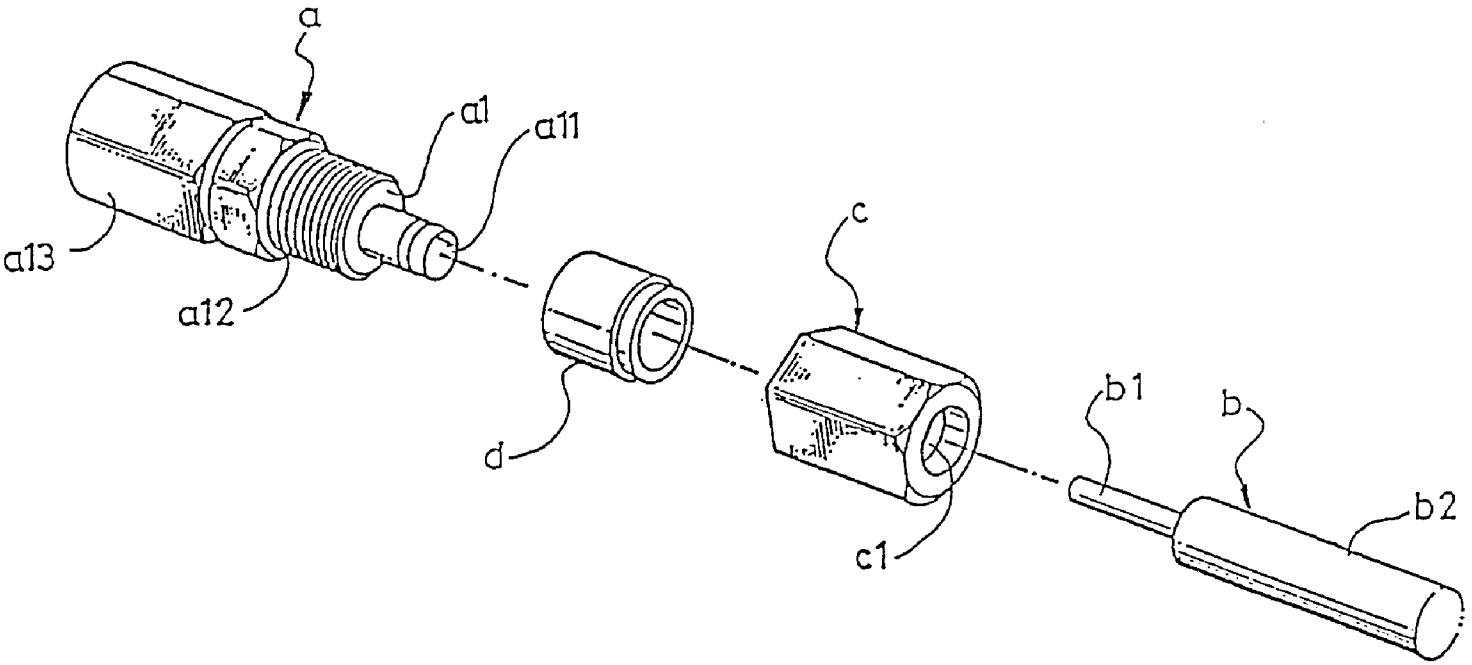
FIG.4 (PRIOR ART)
FIG. 4 shows a conventional exploded elevational view of a prior art.

Referring to FIGS. 1, 2 and 3 in accordance with the invention, at one end of a coaxial cable 1 is provided with a joint 2 comprising an inner tube 21 whose one end is accommodated by an outer tube 22 and the other end is disposed with a color ring 23 and a metal ring 24. In the metal ring 24 and the inner tube 21 is inserted with an inner insertion pipe 25, and between the inner insertion pipe 25 and the metal ring 24 is disposed with an oval ring 26 in order to place the coaxial cable 1 through one end of the inner tube 21 and to push the inner tube 21 into the outer tube 22 such that a center cable 11 of the coaxial cable 1 is penetrated through the inner insertion pipe 25, while leaving the center cable 11 free of contact with the inner insertion pipe 25 and a tubular cable 12 of the coaxial cable 1 in contact and accommodating around the inner insertion pipe 25.

The characteristics of the invention are that, at a front end of the inner tube 21 is an inner awl bore 21*a*, in the outer tube 22 is placed with a leakproof plastic sheath 27 provided with an outer awl bore 27*a* at the interior thereof, so that the inner tube 21 is pushed into the outer tube 22 to have the outer awl bore 27*a* of the leakproof plastic sheath face the inner awl bore 21*a* of the inner tube 21, and to slide the outer awl bore 27*a* of the leakproof plastic sheath 27 into the inner tube 21 to further compress against the leakproof plastic sheath 27, thereby eliminating a gap between the coaxial cable 1 and the outer tube 22 by inflating the leakproof plastic sheath 27.

Referring to FIG. 1 showing the joint 2 before being assembled with one end of the coaxial cable 1, and according to the aforesaid structure, when the coaxial cable 1 is inserted through a rear end of the outer tube 22 of the joint 2, the inner tube 21 is pushed into the outer tube 22 and the inner insertion pipe 25 is placed into the tubular cable 12 of the coaxial cable 1, so that the inner insertion pipe 25 comes into contact with the tubular cable 12 for conduction. Also, the center cable 11 of the coaxial cable 1 is penetrated through the inner insertion pipe 25, and is insulated with the inner insertion pipe 25 using an insulation layer 13 around the center cable 11. Referring to FIG. 2, the outer awl bore 27*a* of the leakproof plastic sheath 27 is faced with the inner awl bore 21*a* of the inner tube 21, and the inner tube 21 is finally pushed into the outer tube 22, such that the outer awl bore 27*a* of the leakproof plastic sheath 27 is slid into the inner tube 21 to further compress against the leakproof plastic sheath 27, thereby eliminating a gap between the coaxial cable 1 and the outer tube 22 by inflating leakproof plastic sheath 27. Referring to FIG. 3, using the above, the joint 2 is assembled onto one end of the coaxial cable 1.

However, when the inner tube 21 is pushed into the outer tube 22, the inner end of the inner tube 21 is placed with the leakproof plastic sheath 27 that is in contact and accommodated around the outer surface of the coaxial cable 1, and the leakproof plastic sheath 27 is displaced due to the inner tube 21 being pushed into the outer tube 22, so the leakproof plastic sheath is compressed and further squeezed tightly against an insulation layer 14 at the surface of the coaxial cable 1. Therefore, a gap between the outer tube 22 and the coaxial cable is eliminated using the leakproof plastic sheath 27 as well as successfully achieving an airtight effect, thereby obtaining leakproof purposes while having easy and rapid assembly for constructors by avoiding complexities of assembling with two hand tools as in the prior art.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A coaxial cable joint comprising a coaxial cable provided with a joint at one end thereof, and the joint further comprising an inner tube whose one end is accommodated by an outer tube and the other end thereof is disposed with a color ring and a metal ring; wherein in the metal ring and the inner tube is inserted with an inner insertion pipe, and between the inner insertion pipe and the metal ring is disposed with an oval ring in order to place the coaxial cable through one end of the inner tube and to push the inner tube into the outer tube, such that a center cable of the coaxial cable is penetrated through the inner insertion pipe, while leaving the center cable free of contact with the inner insertion pipe and a tubular cable of the coaxial cable in contact and accommodating around the inner insertion pipe; and the characteristics of the invention are that:

at a front end of the inner tube is an inner awl bore, and in the outer tube is placed with a leakproof plastic sheath provided with an outer awl bore at the interior thereof, the inner tube is pushed into the outer tube to have the outer awl bore of the leakproof plastic sheath face the inner awl bore of the inner tube, and to slide the outer awl bore of the leakproof plastic sheath into the inner tube to further compress against the leakproof plastic sheath, thereby eliminating a gap between the coaxial cable and the outer tube by inflating the leakproof plastic sheath.

* * * * *